US005911347A

United States Patent [19]

Jackstat et al.

[11] Patent Number: 5,911,347

[45] Date of Patent: Jun. 15, 1999

[54] DOUBLE CIRCLE SHOE HANGER

[75] Inventors: Wilfried H. Jackstat, East Windsor; Charlie Anderson, Ridgewood, both of N.J.

[73] Assignee: Footstar, Inc., Mahwah, N.J.

[21] Appl. No.: 08/938,192

[22] Filed: Sep. 26, 1997

[51] Int. Cl.[6] ..... A47G 25/14; A47G 25/28

[52] U.S. Cl. ..... 223/85; 211/37

[58] Field of Search ..... 223/85, 1, 87, 223/88; 40/322; 211/37

[56] References Cited

U.S. PATENT DOCUMENTS

| | | | |
|---|---|---|---|
| D. 143,795 | 2/1946 | Case . | |
| D. 165,942 | 2/1952 | Stein . | |
| D. 169,429 | 4/1953 | Enrich . | |
| D. 190,352 | 5/1961 | Hackathorn . | |
| 275,581 | 4/1883 | Bundy . | |
| D. 329,951 | 10/1992 | Walter . | |
| D. 330,122 | 10/1992 | Walter . | |
| 600,599 | 3/1898 | Slattery . | |
| 790,190 | 5/1905 | Cooper | 40/322 |
| 1,361,056 | 12/1920 | Hickman . | |
| 1,364,161 | 1/1921 | Uecker . | |
| 1,501,807 | 7/1924 | Petschel . | |
| 1,567,037 | 12/1925 | Cavanna . | |
| 1,567,038 | 12/1925 | Cavanna . | |
| 1,568,330 | 1/1926 | Harding . | |
| 1,626,399 | 4/1927 | Fischer . | |
| 1,634,377 | 7/1927 | Montan et al. | 40/322 |
| 1,820,492 | 8/1931 | Rattazzi . | |
| 1,899,813 | 2/1933 | Lester . | |
| 2,095,900 | 10/1937 | Albert . | |
| 2,107,306 | 2/1938 | Pollinger . | |
| 2,205,817 | 6/1940 | Kramb . | |
| 2,262,459 | 11/1941 | Hoppe . | |
| 2,608,306 | 8/1952 | Mills . | |
| 2,623,582 | 12/1952 | Handley . | |
| 2,623,583 | 12/1952 | Handley . | |
| 2,860,788 | 11/1958 | Hardman . | |
| 2,965,237 | 12/1960 | Wells . | |
| 2,994,462 | 8/1961 | Hirsch et al. . | |
| 3,063,550 | 11/1962 | Boden et al. . | |
| 3,104,013 | 9/1963 | Fisk . | |
| 3,123,850 | 3/1964 | Piken . | |
| 3,539,052 | 11/1970 | Bellock . | |
| 3,563,390 | 2/1971 | Kim . | |
| 3,918,670 | 11/1975 | Doherty . | |
| 4,023,762 | 5/1977 | Batts et al. | 223/85 |
| 4,453,655 | 6/1984 | Smilow et al. . | |
| 4,542,838 | 9/1985 | Perez-Tubens et al. . | |
| 4,768,649 | 9/1988 | Kolton et al. | 40/322 |
| 4,805,816 | 2/1989 | Freund . | |
| 4,823,962 | 4/1989 | Arias . | |
| 4,915,238 | 4/1990 | Cassel . | |
| 4,917,278 | 4/1990 | Ventimiglia . | |
| 5,065,871 | 11/1991 | Chan . | |
| 5,114,017 | 5/1992 | Doyel . | |
| 5,127,528 | 7/1992 | Cone . | |

(List continued on next page.)

FOREIGN PATENT DOCUMENTS

| | | |
|---|---|---|
| 2103081 | 2/1983 | United Kingdom . |

*Primary Examiner*—Bibhu Mohanty
*Attorney, Agent, or Firm*—Seyfarth, Shaw, Fairweather & Geraldson

[57] ABSTRACT

A shoe hanger for displaying a pair of shoes and prominently indicating information regarding same in retail stores includes a central elongated base member, a hook, two shoe support elements and a label support area. The base member terminates at its upper end with the hook, and at its opposite sides with the two shoe support elements onto which a pair of shoes can be fitted. Each shoe support element is generally U-shaped and lies in the same plane as the base member and includes an inside leg and an outside leg, the outside leg angling upwardly toward the inside leg such that the outside leg and inside leg are spaced apart at their respective bottom ends by a bight portion and have their respective upper ends closely adjacent to each other to act as clips to constrain movement, rotational or otherwise, of the shoes fitted thereon. The label support area, which lies in the same plane as the central elongated body and hook, is integral with and located directly above the hook.

11 Claims, 1 Drawing Sheet

U.S. PATENT DOCUMENTS 5,209,382 5/1993 Chang .
5,236,109 8/1993 Zuckerman .
5,282,553 2/1994 Ibled .
5,423,435 6/1995 Pollard et al. .
5,480,073 1/1996 LaManna .
5,511,756 4/1996 Spradling .
5,566,838 10/1996 Tseng .

DOUBLE CIRCLE SHOE HANGER

BACKGROUND OF THE INVENTION

This invention relates generally to a device for displaying footwear, and, more specifically, to such a device which suspends and constrains movement of a pair of shoes, and prominently indicates the trademark, style, size, price and/or other information, for display in retail stores.

Shoe hangers used for display purposes are generally known in the prior art. U.S. Pat. No. 4,823,962, issued on Apr. 25, 1989 to Arias, discloses a shoe display and storage hanger which is used to display shoes in retail stores. The shoe hanger comprises a vertical, elongated, flat central member, which terminates at its upper end with a hook for suspension of the device, and at its lower end with a U-shaped member, which includes two tongue members, extending upwardly and onto which the shoes are fitted. Information regarding the shoes, including the style, price and/or other characteristics, may be indicated on a label support area along the central portion of the vertical, elongated, flat central member. A tab above the hook may indicate the size of the shoe. Importantly, the tongue members are planar and do not effectively constrain movement, rotational or otherwise, of the shoes fitted thereon.

U.S. Pat. No. 5,282,553, issued on Feb. 1, 1994 to Ibled, discloses a shoe holder which is also used to display shoes in retail stores, especially supermarkets. The shoe holder comprises a vertical central rod, which terminates at its upper end with a hook for suspension of the device, and at its lower end with a label support area and two support elements onto which the shoes are fitted. The label support area, which is located at the bottom of the device, can be used to indicate the style, price and/or other characteristics of the shoes. The support elements include planar loops and do not effectively constrain movement, rotational or otherwise, of the shoes displayed thereon.

One problem associated with the shoe hangers taught by Arias and Ibled is that the label support areas are located near the middle or bottom of the devices, respectively, such that information regarding the trademark, style, price and/or other information about the shoes cannot be prominently displayed.

Another problem associated with the shoe hangers disclosed in Arias and Ibled is that the support elements onto which the shoes are fitted are generally planar, and do not effectively constrain movement of the shoes fitted thereon, which can be important for effective presentation purposes.

SUMMARY OF THE INVENTION

It is, therefore, an important object of the invention to provide a shoe hanger which suspends a pair of shoes for display purposes and constrains movement, rotational or otherwise, of the shoes fitted thereon.

It is another object of the invention to provide a shoe hanger which suspends a pair of shoes for display purposes on which the trademark, style, price and/or other relevant information can be prominently indicated.

In summary, there is provided a shoe hanger, which is constructed of plastic, and may be used to suspend and constrain movement of a pair of shoes for display purposes. The shoe hanger comprises a central body, which terminates at its upper end with a hook for suspension of the device and at its lower end with two support elements. The support elements are generally U-shaped, with the outside leg of each "U" angling inward toward the other leg such that the legs of the "U" are spaced apart at the bottom and adjacent to each other at the top of the support element. In use, the outside legs of the support elements are inserted into the shoes such that the top of the vamp of each shoe slides between the inside and outside legs of the support elements. Thus, the support elements act as "clips" and constrain movement, rotational or otherwise, of the shoes. The trademark, style, price, size and/or other characteristics of the shoes may be prominently indicated on a rectangular display area located above, and integral with, the hook of the device.

Further objects, features and advantages of the invention will become evident from a consideration of the following detailed description when taken in conjunction with the accompanying drawings and appended claims.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction, and operation, and many of its advantages should be readily understood and appreciated.

DETAILED DESCRIPTION OF THE PREFERRED EMBODIMENT

Figure 1:
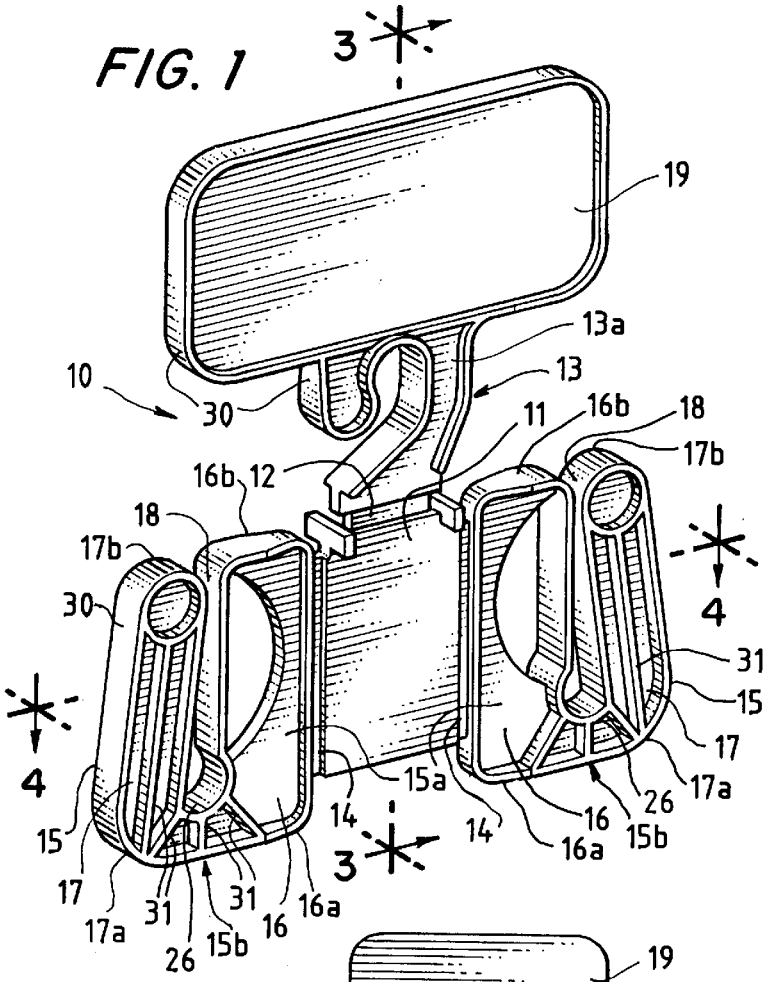
FIG. 1 is a perspective view of a shoe hanger in accordance with a preferred embodiment of the invention.

Turning now to FIGS. 1 through 4, there is depicted a shoe hanger (10) in accordance with a preferred embodiment of the invention. The shoe hanger (10) includes a central elongated base member (11), a hook (13), two shoe support elements (15) and a label support area (19). The entire hanger (10) is preferably of unitary, one-piece construction and is made of a rigid material, preferably a suitable plastic.

Figure 3:
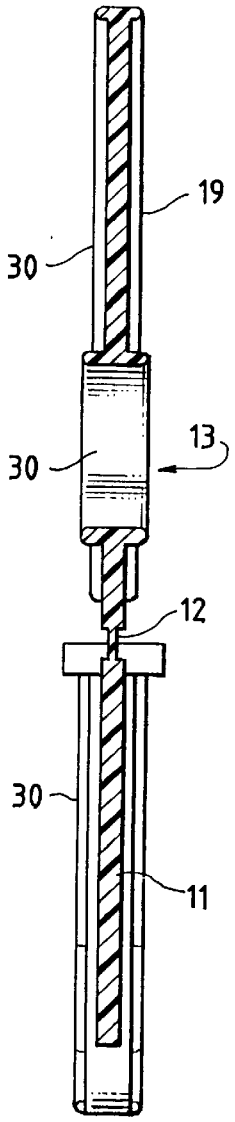
FIG. 3 is an enlarged vertical sectional view taken along the line 3—3 in FIG. 1.
Figure 2:
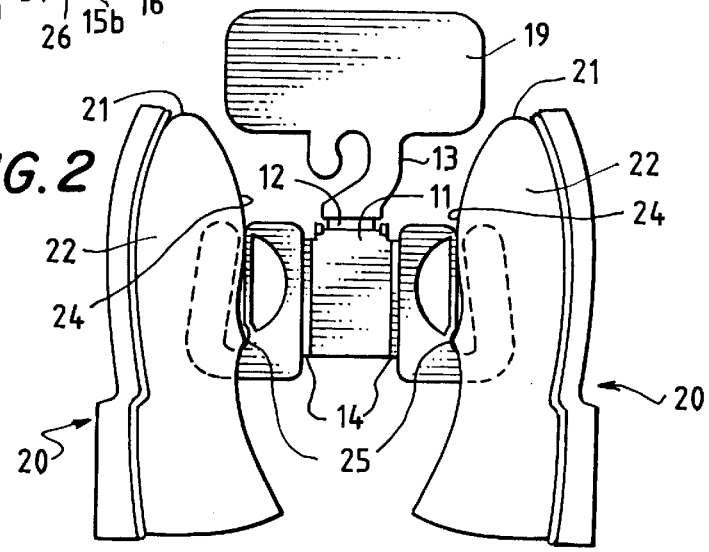
FIG. 2 is a reduced front elevational view of the shoe hanger of FIG. 1, with a pair of shoes fitted thereon to show the shoe hanger in use.
Figure 4:
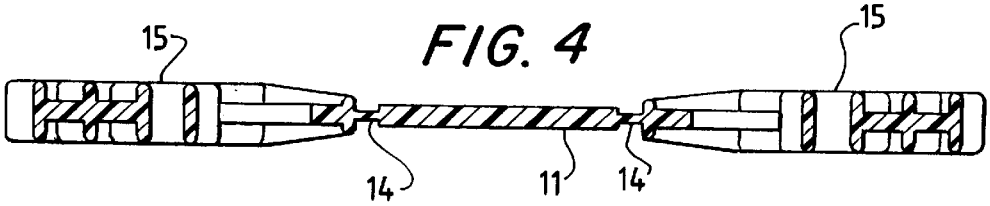
FIG. 4 is an enlarged horizontal sectional view taken along the line 4—4 in FIG. 1.

As shown in FIGS. 2 and 3, base member (11) is a generally flat planar member oriented vertically in use and terminates at its upper end (12) with hook (13), and at its opposite sides (14) with support elements (15), respectively. As best shown in FIGS. 2 and 3, hook (13) has a flat planar web portion **(13*a*) which lies in the same plane as base member (11) and allows the hanger (10)** to be suspended from a peg on a display board, a lateral support rail, or any other suitable lateral support means (not shown).

As shown in FIG. 1, label support area (19) is a flat rectangular area integral with, and located directly above, hook (13) and lies in the same plane as base member (11) and hook (13). The trademark, style, price, size and/or other relevant information about the shoes fitted on the device (10) may be prominently indicated at label support area (19).

Each support element (15) extends parallel to base member (11) along substantially the entire height thereof, and includes a flat, planar web portion **(15*a*) which lies in the same plane as base member (11). Each support element (15) is generally U-shaped and comprises an inside leg (16) and an outside leg (17). The lower ends (16*a*, 17*a*) of the inside (16) and outside legs (17) are joined by a bight portion (15*b*)**.

The outside legs (17) extend upwardly and angle inwardly respectively toward the inside legs (16) from their lower ends **(17*a*) to their upper ends (17*b*) such that the upper ends (16*b*, 17*b*) of the inside (16) and outside legs (17) are adjacent to each other at locations (18)**.

The web portions **(13*a* and 15*a*) of the hook (13) and shoe support elements (15), and the label support area (19), are all bounded along their entire periphery by a peripheral flange (30) which extends substantially perpendicular to the plane of the web portions substantially equal distances from opposite sides thereof to rigidify the structure. Additional reinforcing or rigidifying walls or webs (31) may extend between portions of the peripheral flange (30) to provide additional rigidification and stiffening in the shoe support elements (15)**.

Turning now to FIG. 2, a pair of shoes (20) are positioned onto shoe support elements (15). The outside legs (17) of shoe support elements (15) are inserted into the shoes (20) such that the front edges (25) of the vamps (22) of the shoes (20) slide between the inside legs (16) and outside legs (17) of the support elements (15). The tops (24) of the vamps (22) slide downward between the inside legs (16) and outside legs (17) until either the front edge (25) of the vamp (22) comes in contact with bottom (26) of the support elements (15) or the upper end **(17*b*) of outside legs (17) slides forward toward toe (21) until it cannot slide forward any further. The shoes (20) are suspended vertically with toes (21) pointed upward and tops (24) of each vamp (22) facing inward toward the central elongated member (11). As can best be seen in FIGS. 1 and 2, support elements (15) constrain movement, rotational or otherwise, of the shoes (20)** fitted thereon.

The trademark, style, price, size and/or other characteristics regarding the shoes (20) may be indicated at label support area (19), which is located at the top of the device (10) and serves to prominently display information about the shoes (20) to the consumer.

Hook (13) allows the device (10) to be suspended from a peg on a display board, a lateral support rail or any other suitable lateral support means.

When a consumer desires to more closely examine, or try on, a particular pair of shoes, he or she may remove the shoe hanger (10), and the shoes (20) fitted thereon, from the display board or lateral support rail by grasping the shoe hanger (10) at or near the hook (13) or label support area (19). Once the hanger (10) is removed from the display board, the shoes (20) may be easily removed from the hanger (10) by fixing the hanger (10) and sliding the shoes (20) upward with respect to the hanger (10) such that the outside legs (17) of the support elements (15) slide out of the shoes (20). The empty hanger (10) may then be returned to the display board or placed in a bin to be recirculated at a later time.

The invention has been described in an illustrative manner, and it is to be understood that terminology which has been used is intended to be in the nature of description rather than that of limitation. Obviously, many modifications and variations of the present invention are possible in light of the above teachings. It is, therefore, to be understood that within the scope of the claims, the invention may be practiced otherwise than as specifically described.

What is claimed is:

1. A shoe hanger for displaying a pair of shoes comprising:

a central elongated base member;

a hook;

two shoe support elements; and a label support area;

wherein said central elongated member, hook, label support area and support elements extend parallel to the same plane;

said base member terminating at its upper end with said hook, and at its sides with said shoe support elements;

said label support area being integral with and located directly above said hook and having a width substantially greater than that of said hook;

each of said shoe support elements being generally U-shaped and including inner and outer legs joined at lower ends thereof by a bight portion;

each of said hook and said label support area and said support elements having a reinforcing flange extending from both sides thereof alone the outer periphery thereof substantially perpendicular to said plane;

the upper ends of said legs of each shoe support element being disposed at the upper end of said base member and more closely adjacent to each other than are the lower ends for cooperating to define a clip for receiving and gripping therebetween the vamp of an associated shoe.

2. The shoe hanger of claim 1, said shoe hanger being of a unitary, one-piece construction.

3. The shoe hanger of claim 1, wherein each of said clips includes a planar web portion, said web portions being substantially coplanar.

4. The shoe hanger of claim 1, and further comprising a label support area.

5. The shoe hanger of claim 4, wherein said hook is disposed between said base member and said label support area.

6. The shoe hanger of claim 1, wherein said base member has substantially the same width along its entire length.

7. The shoe hanger of claim 1, wherein said label support area is rectangular in shape.

8. The shoe hanger of claim 7, wherein said label support area has a width substantially greater than its height.

9. The shoe hanger of claim 8, wherein said width of said label support area is substantially greater than the width of any other portion of the hanger.

10. The shoe hanger of claim 1, wherein each of said legs has a length greater than that of said base member.

11. The shoe hanger of claim 1, and further comprising a reduced-thickness upper neck portion joining said upper end of said base member with said hook, and reduced-thickness lateral neck portions respectively joining the sides of said base member with said shoe support elements.

* * * * *